US006373394B1

(12) United States Patent
Zhang

(10) Patent No.: US 6,373,394 B1
(45) Date of Patent: Apr. 16, 2002

(54) HEAT DISSIPATION AND THERMAL INDICATION FOR WHEEL SET ASSEMBLY

(76) Inventor: Ming Zhang, 5270 Rosedale Ave., Montreal, Quebec (CA), H4V 2H6

( * ) Notice: Subject to any disclaimer, the term of this patent is extended or adjusted under 35 U.S.C. 154(b) by 0 days.

(21) Appl. No.: 09/645,185

(22) Filed: Aug. 24, 2000

(51) Int. Cl.[7] ..... G08B 17/00

(52) U.S. Cl. ..... 340/584; 340/589; 340/682; 384/476; 384/900

(58) Field of Search ..... 340/907, 682, 340/449, 588, 589, 584; 374/135; 246/169 A; 384/476, 900, 488, 624, 317

(56) References Cited

U.S. PATENT DOCUMENTS

| | | | | | |
|---|---|---|---|---|---|
| 3,442,249 | A | * | 5/1969 | Jamision et al. | 116/114.5 |
| 3,569,695 | A | * | 3/1971 | Ralph | 246/169 D |
| 4,119,284 | A | * | 10/1978 | Belmont | 246/169 A |
| 4,501,006 | A | * | 2/1985 | Korenberg | 377/45 |
| 4,773,350 | A | * | 9/1988 | Lyons | 116/214 |
| 4,812,826 | A | | 3/1989 | Kaufman et al. | |
| 5,633,628 | A | * | 5/1997 | Denny et al. | 340/584 |

* cited by examiner

*Primary Examiner*—Jeffery Hofsass
*Assistant Examiner*—Son Tang

(57) ABSTRACT

The present invention provides a method for constant and rapid heat dissipation and thermal indication for railway wheel set assemblies. The method comprises assembling a vehicle wheel set by mounting bearings and wheels on an axle with interference fit and mounting bearing adapter onto bearings. Heat pipes are embedded within the said vehicle wheel set. The heat pipes provide heat sinks for the vehicle wheel set assembly causing a fluid within the heat pipe to vaporize on sections of heat pipe more adjacent to the bearing assemblies and to condense on other sections of heat pipes more adjacent to the heat dissipation areas. The heat dissipation area can be either the surfaces of the wheel set assembly or the surfaces of additional cooling fins mounted on the wheel set assembly. The embedment of heat pipes within the wheel set assembly thus enables constant cooling for bearing assembly. The heat is transferred within the heat pipes from the bearing assemblies to the heat dissipation areas, then to the atmosphere. Meanwhile, the rises of temperature in the thermal indication areas that are included in the heat dissipation areas and are monitored by either wayside hot box detectors or onboard thermal sensors, provide precise thermal indications of the interior running conditions of the bearing assemblies.

5 Claims, 4 Drawing Sheets

HEAT DISSIPATION AND THERMAL INDICATION FOR WHEEL SET ASSEMBLY

TECHNICAL FIELD

The present invention relates generally to heat dissipation and heat sensitive warning methods and apparatus to protect railway wheel set assemblies from severe thermal damages, to help detection of failed bearings and prevention of bearing failure related derailments. In particular, the present invention relates to method and apparatus for constant thermal indication and constant heat dissipation with heat pipes embedded within vehicle wheel set assemblies.

BACKGROUND OF THE INVENTION

Overheated bearings on railroad vehicles are the results of either improper bearing mounting process or incipient bearing problems. Some overheated bearings have led to catastrophic failures and train derailments costing the North American railroads millions of dollars each year.

Among various methods proposed for timely detection of troubled bearings in order to replace them, wayside hot bearing detection systems using infrared sensors are representative of the state of the art and presently applied in high traffic areas.

Despite all the technical advancements of wayside hot box detectors, the occurrence of bearing burnoff related derailment remains at a constant rate over the past several years for freight cars and in the mean time costs are escalating for false alarm set-offs which result in unnecessary train stops. Moreover, it is found difficult to adapt the hot box detector to the inboard bearing type of wheel set which is used widely in passenger and transit trains.

The major operational problem of bearing burnoffs is associated with the facts that hot bearing detectors are typically spaced at 15 to 30 mile intervals, and a burnoff that can happen in seconds or minutes may occur between detectors. Unnecessary stops caused by false alarms of hot bearing detectors are believed related to brake heat radiation during drag braking on wheels. Up till now, no promising methods have been proposed to further improve the performance of the presently installed hot bearing detection systems to reduce simultaneously the risks of derailments and the number of false alarms.

Several bearing failure detection methods and devices using complete different approaches have been suggested, such as:

(1) wayside and on-board acoustic bearing detectors using bearing acoustic and vibration signatures to detect incipient bearing failure; (Advanced Roller Bearing Inspection Systems, G. B. Anderson et al, $12^{th}$ International Wheelset congress, September 1998);

(2) on-board overheated bearing detecting systems such as wax motor activated electronic indicators within hollow cap screws or fusible material and spring activated visual indicators in axle centers (U.S. Pat. No. 4,119,284, Belmont, U.S Pat. No. 4812826, Kaufman, et al, and U.S. Pat. No. 5,633,628, Denny, et al).

However, none of them have found high degrees of acceptance by North American railways due to concerns on whether they are more effective or more reliable alternatives.

During normal operation, a certain amount of heat is generated inside bearings due to the friction among the moving components. The heat generated by a properly functioning bearing can be readily transferred to the atmosphere through the bearing itself and the surrounding components of the wheel set assembly such as the axle, the wheels and the bearing adapters with an adequate margin of safety. However, when the axle and bearings are in a failure mode, limited capacity of wheel set assembly to transfer heat due to relatively low thermal conductivity of carbon steel results in high bearing temperatures. Hot bearing detection systems are designed on the basis of different thermal signatures of normal and failing bearings.

The presently installed wayside hot box detectors are designed to detect the bearings which have progressed into the later stage of incipient failure phase by the rising temperature. Those hot box detectors rely on the measurement of infrared energy radiated from the exterior surface of bearing and axle assembly to determine the assembly's interior temperature.

Due to relatively low thermal conductivity of carbon steel, a thermal gradient is developed between the overheated zone within the axle/bearing assembly and the scan envelope of the hot box detector on the outside surfaces of the wheel set assembly. The thermal gradient makes a notable negative impact on the detectability of hot box detectors. In virtue of the thermal gradient, a threshold temperature in the scan envelope much lower than failure indicative temperature inside bearing has to be set up to trigger the alarm in order to keep sufficient margin of safety. However, the dilemma is that lower threshold temperature may bring many false alarms ignited by other ambient heating effects, for example, drag braking on wheels.

Another deficiency of the present hot bearing detection systems is associated with the present setup of hot box detectors spaced at 15 or 30 mile intervals. With this set up, an overheated bearing that has not led to an immediate catastrophic failure can be picked up and removed from the service in time. However, in certain conditions, bearing failure can progress very fast and it reaches the final burnoff stage very quickly. A Tremendous amount of heat generated and accumulated in the rapidly progressed failure process leads to immediate decomposition of lubricant, severe degradation of bearing components and finally catastrophic derailment before the train reaches the next available hot box detector.

Accordingly, what is needed in the art is an improved method and apparatus to give constantly precise indication of interior temperatures of the bearing/axle assembly to the hot bearing detection systems and to provide the hot bearing detection system with sufficient time to pick up the overheated bearings by retarding the bearing failure progress through rapid heat dissipation.

SUMMARY OF THE INVENTION

One object of the present invention is to provide a method and apparatus for precise thermal indication of interior temperature of the bearing/axle assembly that will enable hot bearing detection systems to identify accurately overheated bearings without false alarms.

Another object of the present invention is to provide a rapid heat dissipation method and apparatus that is able to retard the bearing failure progress by fast cooling so as to give the detecting systems sufficient time to locate the failed bearings.

These objects of invention can be accomplished simultaneously by embedding heat pipes within the vehicle wheel set assembly that allows fast heat transfer:

(a) from the interior of the bearing and axle journal to heat dissipation areas either on surfaces of existing wheel set assembly components or on surfaces of additional cooling fins mounted on the wheel set assembly.

(b) from overheated zone inside the bearing and the axle where heat starts to build up, to thermal indication areas monitored by hot bearing detection systems or other types of thermal sensors.

Other objects and advantages of the present invention can become more apparent to those skilled in the art as the nature of the invention is better understood from the accompanying drawings and a detailed description.

DETAILED DESCRIPTION OF THE DRAWINGS

Figure 1:
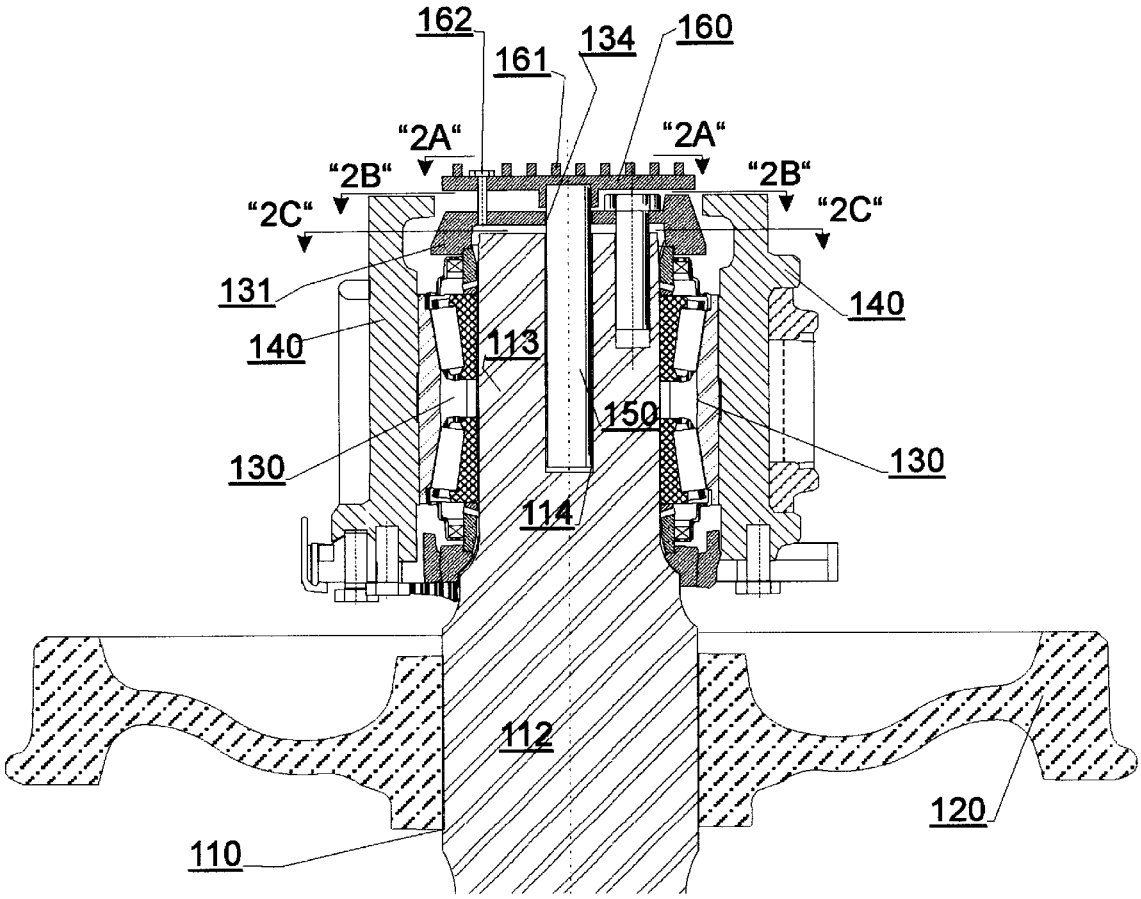
FIG. 1 is a sectional cut away view of one embodiment of the present invention with a solid axle and outboard bearings.

Referring to FIG. 1, half of a vehicle wheel set assembly is provided including a solid axle 110, a curved plate wheel 120, an outboard tapered roller bearing assembly 130 and a roller bearing adapter 140.

The wheel 120 is mounted and secured on the axle 110 with interference fit. The bearing assembly 130 is mounted with interference fit and retained by an end cap 131 bolted to the end of the axle 110. The roller bearing adapter 140 is slid onto the roller bearing 130 for placement of wheel set assembly under a rail truck. The outboard bearing refers to the outer position of the bearing assembly 130 on the axle 110 relative to the wheel 120.

The section of the axle 110 under the wheel 120 is referred as axle wheel seat and indicated by number 112. The section of the said axle 110 under the bearing assembly 130 is referred as axle journal and indicated by number 113.

The axle 110 of the present invention has a hole 114 in the center of the axle journal 113. The hole 114 stretches across the axle journal 113 and can be extended to the axle wheel seat 112 (not shown in FIG. 1). Within the said hole 114 is inserted an assembly of heat pipe 150 and a cooling fin 160. The said assembly of heat pipe 150 and cooling fin 160 is then screw mounted into the threaded opening in the center of the axle end cap 131 and secured with a locking bolt 162 screwed on to the said axle end cap 131.

Figure 2A:
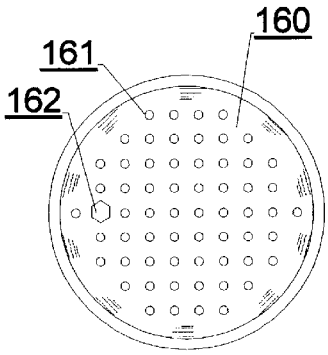
FIG. 2A is an end view of the apparatus depicted in FIG. 1 taken along line 2A—2A.
Figure 2B:
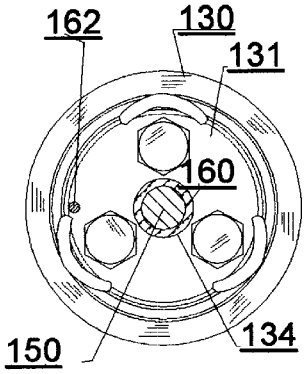
FIG. 2B is a cross sectional view of the apparatus depicted in FIG. 1 taken along line 2B—2B.
Figure 2C:
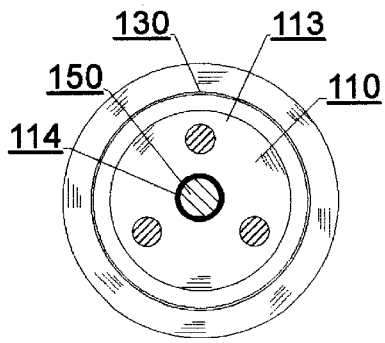
FIG. 2C is a cross sectional view of the apparatus depicted in FIG. 1 taken along line 2C—2C.

Before being inserted into the axle 110, the cooling fin 160 and the heat pipe 150 are attached to each other by creating a threaded bore on one side of the cooling fin 160 and screw mounting the heat pipe 150 into the threaded bore. The end view of the cooling fin 160 with studs 161, the end view of axle end cup 131 and the end view of axle 110 are shown in FIG. 2A, 2B and 2C respectively.

The heat pipe 150 has an exterior metal shell and a capillary wick structure lined inside the shell wall. The gas-tight container provided by the metal shell contains a small amount of vaporizable fluid. The heat pipe and cooling fin is made of any suitable thermal conductive material including but not limited to, copper, copper alloy, aluminum or aluminum alloys.

In operation, the heat generated inside bearing 130 or between the axle journal 113 and bearing 130 is transferred to the heat pipe 150 through axle journal 113. The section of the heat pipe 150 under the bearing assembly 130 serves as a heat sink in which the fluid inside the heat pipe vaporizes. The fluid then flows towards the cooler end in contact with the cooling fin 160 where the vapor of the fluid condenses. The said cooling fin 160, which is rotated with the rotating axle 110, then dissipates the heat into the atmosphere with the help of studs 161. The bearing runs at lower temperatures and the lifetime of the bearing is extended. In the failing mode, rise of temperature in the bearing is immediately reflected in the cooling fin located within the scanning envelop of hot box detectors, meanwhile, a large amount of heat is conducted from the bearing.

Figure 3:
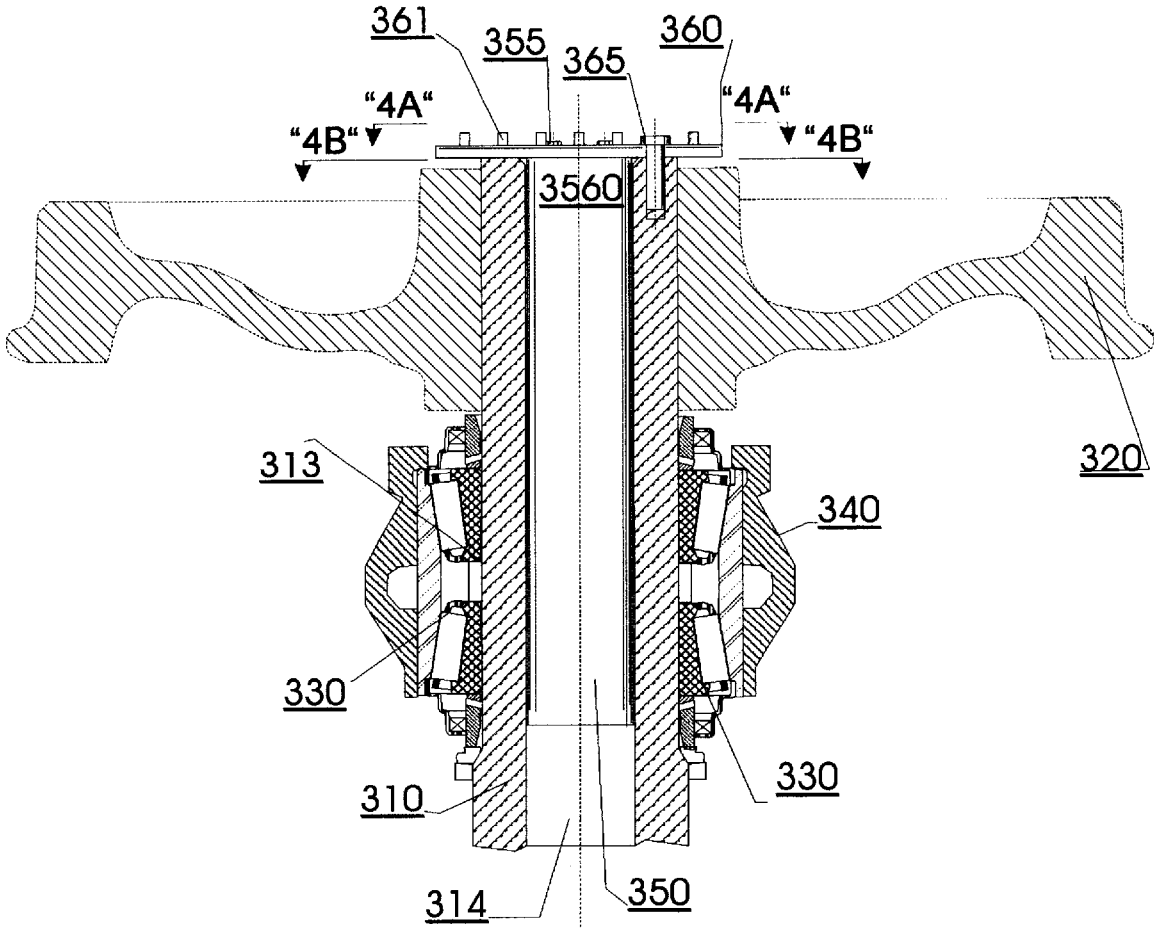
FIG. 3 is a sectional cut away view of an alternate embodiment of the present invention with a hollow and inboard bearings.

Referring to FIG. 3, half of a wheel set assembly including a hollow axle 310, a curved wheel 320, an inboard tapered roller bearing assembly 330 and a roller bearing adapter 340 is provided. The inboard bearing refers to the inner position of the bearing assembly 330 on the axle 310 relative to the wheel 320. Wheel set assemblies with inboard bearings are used widely in passenger and rapid transit equipment.

In this embodiment the heat pipe 350 and the cooling fin 360 are pre-assembled by screws 355. The assembly of heat pipe 350 and cooling fin 360 is referred as integrated pipe 3560.

Figure 4A:
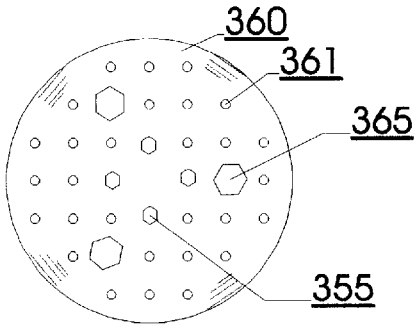
FIG. 4A is an end view of the apparatus depicted in FIG. 3 taken along line 4A—4A.
Figure 4B:
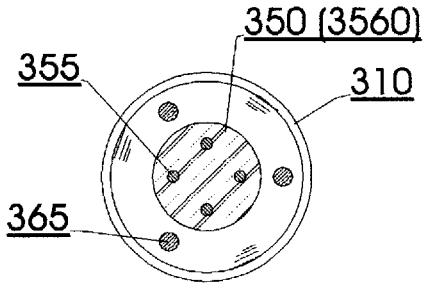
FIG. 4B is a cross sectional view of the apparatus depicted in FIG. 3 taken along line 4B—4B.

Taking advantage of the existing bore 314 in the center of the hollow axle 310, the integrated pipe 3560 is mounted into the hollow axle 310 with interference fit. The said integrated pipe 3560 is then fixed with the hollow axle by three cap screws 365. The cooling fin 360 acts also as an axle end cap. The end view of the integrated pipe 3560 and the end view of the axle 310 are shown in FIG. 4A and FIG. 4B respectively.

In operation, the heat originated from within the bearing 330 and the axle journal 313 is transferred to the heat pipe 350 through axle journal 313. The section of heat pipe 350 in the said axle journal area 313 serves as a heat sink in which the fluid inside the heat pipe vaporizes. The fluid then flows towards the cooler section in contact with the axle wheel seat 312 and cooling fin 360 where the vapor of the fluid condenses. The said heat is then dissipated to the atmosphere through the rotating cooling fin 360 and the rotating wheel 320. The rapid heat transfer within heat pipe between the inboard bearing 330 and the cooling fin 360 located within the standard scanning envelop of hot box detector at the end of axle makes the inboard bearing detectable by the hot box detectors presently installed for outboard bearings.

The construction principle of heat pipe 350 is the same as the heat pipe 150 depicted in FIG. 1. The cooling fin 360 and the screw 365 and 355 are made of any suitable thermal conductive material including, but not limited to, copper, copper alloy, aluminum and aluminum alloys.

Figure 5:
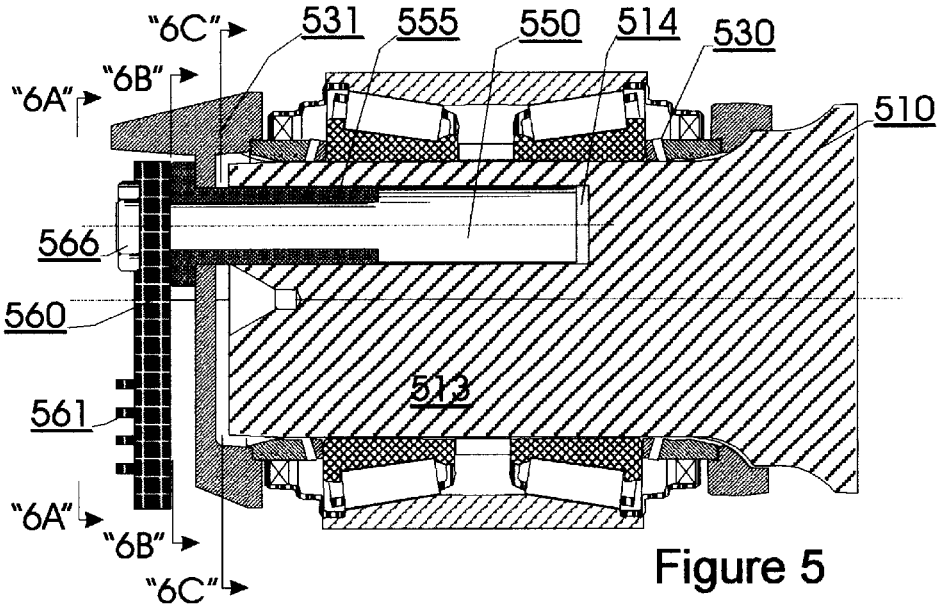
FIG. 5 is a sectional cut away view of another alternate embodiment of the present invention with a solid axle wheel set with outboard bearings.

Referring to FIG. 5, journal section (referred as axle journal 513) of an axle 510 and an outboard roller bearing assembly 530 are provided.

In this embodiment of the present invention, the axle journal 513 has enlarged threaded holes 514 compared with the standard holes in order to receive specially made hollow cap screws 555. The inner bores of the hollow screws 555 are threaded to receive a heat pipe 550. The enlarged outside diameter of the cap screws 555 assures the same mechanical strengths as the standard solid cap screw. While this embodiment uses enlarged hollow cap screws and enlarged holes in axle journal, it is to be understood that the present invention can also be realized by creating three additional holes for heat pipes 550 at the end of axle 510 while keeping the existing holes and cap screws intact.

Figure 6A:
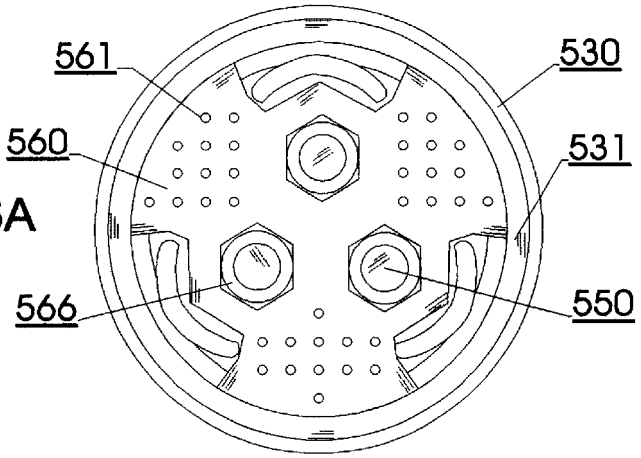
FIG. 6A is an end view of the apparatus depicted in FIG. 5 taken along line 6A—6A.
Figure 6B:
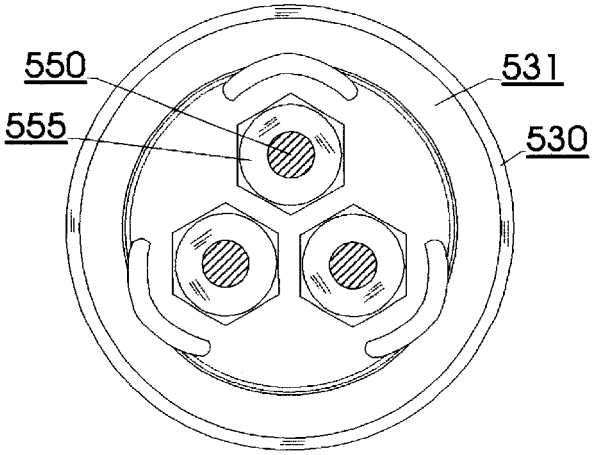
FIG. 6B is a cross sectional view of the apparatus depicted in FIG. 5 taken along line 6B—6B.
Figure 6C:
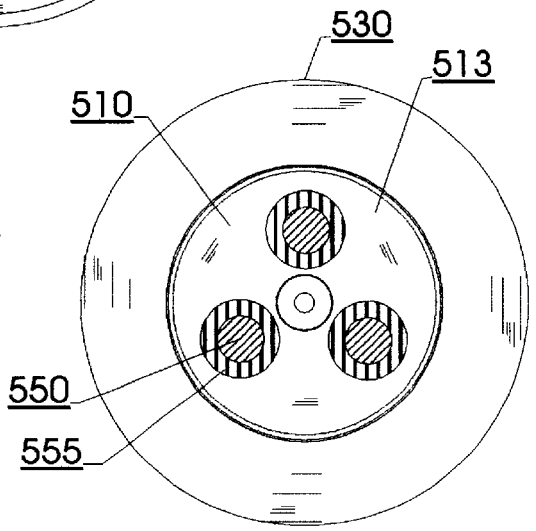
FIG. 6C is a cross sectional view of the apparatus depicted in FIG. 5 taken along line 6C—6C.

The said cap screws 555 together with the heat pipes 550 are passed through the openings in the axle end cap 531 and screw mounted into the said holes 514 at the end of axle 510 according to the standard bearing mounting procedure. A cooling fin is then mounted on top of the cap screws and secured with nuts 566. The end view of the cooling fin 560 with studs 561, the end view of axle end cap 531 and the end view of axle 510 are shown in FIG. 6A, FIG. 6B and FIG. 6C respectively.

The construction principle of heat pipes 550 is the same as the heat pipe 150 depicted in FIG. 1. The cooling fin 560 and the nuts 566 are made of any suitable thermal conductive material including, but not limited to, copper, copper alloy, aluminum and aluminum alloys.

In operation, the heat produced within the bearing 530 and axle journal 513 is transferred to the heat pipes 550 through axle journal 513. The section of heat pipes in axle journal area 513 serves as a heat sink in which the fluid inside the heat pipe vaporizes. The fluid then flows towards the cooler section in contact with cooling fin 560 where the vapor of the fluid condenses. The said heat is then dissipated to the atmosphere through the rotating cooling fin with the help of the studs 561. A change of bearing temperature is immediately reflected by the temperature of cooling fin located within the scanning envelope of hot box detectors.

Figure 7:
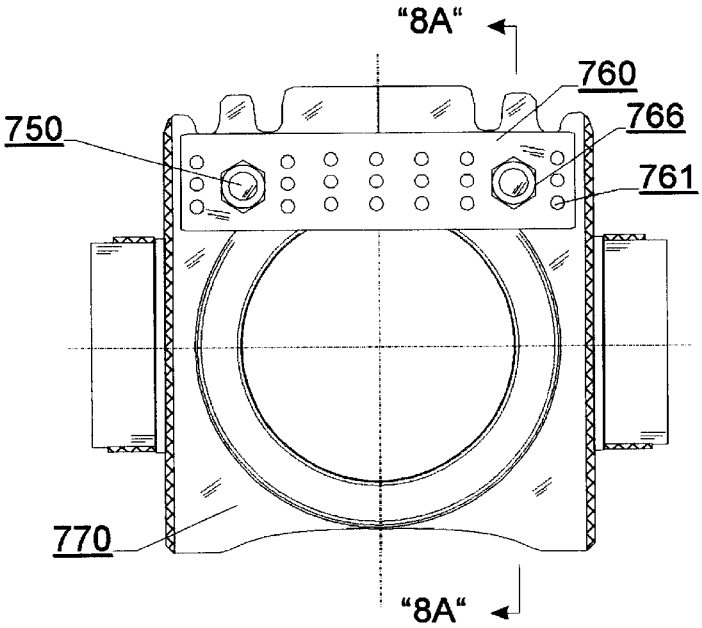
FIG. 7 is a half-sectional end view of another alternate embodiment of the present invention with an outboard bearing adapter.

Referring to FIG. 7, a half section of a roller bearing adapter 770 is provided. (The assembly of roller bearing and roller bearing adapter can be seen in FIG. 1).

Figure 8A:
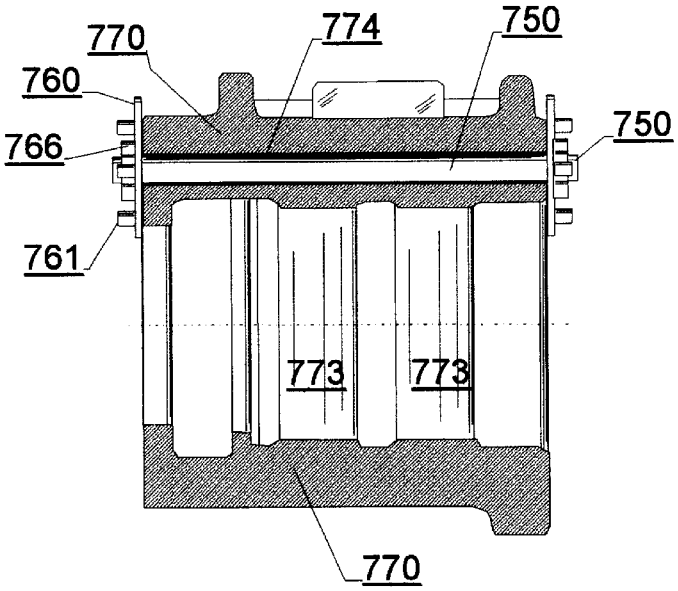
FIG. 8A is a cross sectional view of the apparatus depicted in FIG. 7 taken along line 8A—8A.
Figure 8B:
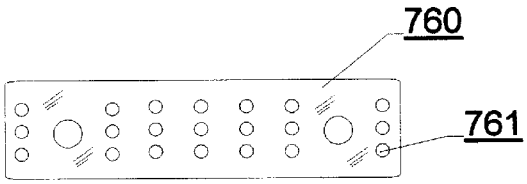
FIG. 8B is an end view of cooling fin depicted in FIG. 7.

Referring to FIG. 8A, which is a cross sectional view of the apparatus shown in FIG. 7 taken along line 8A—8A, the roller bearing adapter 770 of the present invention has two holes 774 (only one is shown) created across the adapter 770. Two heat pipes 750 (only one is shown) are inserted into the said holes 774 with interference fit. Two cooling fins 760 with studs 761 are fixed on each side of the bearing adapter by nuts 766. Two protruding bore sections inside bearing adapter 770 which correspond to the positions of two bearing cones inside bearing assembly are referred as critical areas 773.

The construction principle of heat pipe 750 is the same as the heat pipe 150 depicted in FIG. 1. The cooling fin 760 and the nuts 766 are made of any suitable thermal conductive material including, but not limited to, copper, copper alloy, aluminum and aluminum alloys.

In operation, the heat generated inside the bearing is transferred from the bearing to the critical areas 773 inside the bearing adapter 770, and then to the middle section of the said heat pipes 750. The middle section of the said heat pipe 750 across the two critical areas 773 serves as a heat sink in which the fluid inside the heat pipe vaporizes. The fluid then flows towards both ends of the heat pipe 750 in contact with cooling fins 760 where the vapor of the fluid condenses. The said heat is then dissipated into the atmosphere through the cooling fins 760 with the help of studs 761. The bearing located within the bearing adapter runs at lower temperatures and temperature of cooling fin 760 monitored by hot bearing detection systems responds immediately to the changes of bearing temperature.

REMARKS

1. While the present invention is initially designed for improving performance of wayside hot box detectors, it is to be understood that the present invention is also applicable for use with other on board or wayside type of hot bearing detection systems with the benefits of precise thermal indication of interior bearing temperature and prolonged safe detection time window.

2. While all the embodiments of the present invention are depicted and described with a tapered roller bearing assembly mounted on a railway car wheel set, it is to be understood that the present invention is also applicable for uses with other types of wheel set assemblies and with other types of bearing and bearing adapter assemblies.

3. While cooling fins described in the aforesaid embodiments are preferable options of the present invention, it is to be understood that (a) fast heat transfer can be achieved from within the bearing and axle journal to the atmosphere without installing additional cooling fins.

The heat pipes can be connected to the outside surfaces of the wheel set assembly such as the end of axle and/or the axle end cap 131 and/or the outside surface of the bearing adapter etc. In addition, applying suitable thermal conductive coatings or deposits on the outside surfaces of the wheel set assembly can further enhance the heat dissipation capacity.

(b) the cooling fin can be made differently, for example, a series of thin fins separated by washer-like spacers and fixed on the heat pipe by a nut.

While a few of the embodiments of the present invention have been explained, it will be readily apparent to those skilled in the art of the various modifications which can be made to the present invention without departing from the spirit and scope of this application as it is encompassed by the following claims.

What I claim as my invention is:

1. An apparatus for heat dissipation and/or thermal indication of a vehicle wheel set assembly, the apparatus comprising:

(a) a vehicle wheel set assembly including bearings and wheels mounted on an axle with interference fit, bearing adapters mounted onto said bearing assemblies;

(b) heat dissipation areas on the surfaces of the said vehicle wheel set assembly or on the surfaces of additional heat dissipation components mounted to the said vehicle wheel set assembly;

(c) thermal indication areas monitored by either wayside detectors or on board sensors, the said thermal indication areas being included within the said heat dissipation areas;

(d) heat pipe means embedded in the said vehicle wheel set assembly, the said heat pipe means providing (1) heat sinks for the said vehicle wheel set assembly causing a fluid inside the said heat pipe means to vaporize on the sections of the said heat pipe means adjacent to the said bearing assemblies and to condense on other sections of the said heat pipe means adjacent to the said heat dissipation areas to transfer heat from the said bearing assemblies to the said heat dissipation areas for dispersion from the said heat dissipation areas into the atmosphere;

(2) thermal indications of the said vehicle wheel set assembly by changes of temperatures in the said thermal indication areas as a result of the aforesaid heat transfer from the said bearing assemblies to the said thermal indication areas by the said heat pipe means.

2. The apparatus in claim 1, wherein the vehicle wheel set assembly is equipped with either inboard bearings, outboard bearings or suspension bearings and the said vehicle wheel set assembly is one of the following types: freight car wheel set assembly, passenger or transit car wheel set assembly and locomotive traction motor wheel set assembly.

3. The apparatus in claim 1, wherein the said heat pipe means are embedded in one or a combination of following locations within the said vehicle wheel set assembly including: center of the solid axle, inner bore of the hollow axle, enlarged cap screw holes at the end of the axle, additional holes at the end of the axle, and holes in the bearing adapter.

4. The apparatus in claim 1, wherein the said additional heat dissipation components are cooling fins mounted at the end of the axle, cooling fins mounted on the axle end caps, cooling fins mounted on the cap screws, or cooling fins mounted on the sides of bearing adapters.

5. A method of heat dissipation and/or thermal indication for a vehicle wheel set assembly, said method in combination comprising:

(a) assembling a vehicle wheel set by mounting bearing assemblies and wheels on an axle with interference fit and mounting bearing adapters onto the said bearings assemblies;

(b) selecting heat dissipation areas on the surfaces of the said vehicle wheel set assembly or mounting additional heat dissipation components;

(c) including within the said heat dissipation areas thermal indication areas that are monitored by either wayside detectors or onboard sensors;

(d) embedding within the said vehicle wheel set heat pipe means providing (1) heat sinks for the said vehicle wheel set assembly causing a fluid inside the said heat pipe means to vaporize on the sections of the said heat pipe means adjacent to the said bearing assemblies of the said vehicle wheel set assembly and to condense on other sections of the said heat pipe means adjacent to said heat dissipation areas to transfer heat from the said bearing assemblies to said heat dissipation areas for dispersion from the said heat dissipation areas into the atmosphere;

(2) thermal indications of the said vehicle wheel set assembly by changes of temperature in the said thermal indication areas as a result of the aforesaid heat transfer from the said bearing assemblies to the said thermal indication areas by the said heat pipe means.

* * * * *